US010228640B2

(12) United States Patent
Yamazaki et al.

(10) Patent No.: US 10,228,640 B2
(45) Date of Patent: Mar. 12, 2019

(54) IMAGE FORMING APPARATUS HAVING A COMPRESSOR THAT OUTPUTS AIR TO SEPARATE A SHEET FROM A FIXING ROLLER

(71) Applicant: CANON KABUSHIKI KAISHA, Tokyo (JP)

(72) Inventors: Yoshitaka Yamazaki, Abiko (JP); Takashi Umemoto, Kariya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/642,828

(22) Filed: Jul. 6, 2017

(65) Prior Publication Data

US 2018/0032006 A1 Feb. 1, 2018

(30) Foreign Application Priority Data

Jul. 28, 2016 (JP) ..... 2016-148356
Jul. 28, 2016 (JP) ..... 2016-148357
Oct. 14, 2016 (JP) ..... 2016-202312

(51) Int. Cl.
*G03G 15/00* (2006.01)
*G03G 15/20* (2006.01)

(52) U.S. Cl.
CPC ..... *G03G 15/2028* (2013.01); *G03G 15/5029* (2013.01); *G03G 15/80* (2013.01)

(58) Field of Classification Search
CPC ..... G03G 15/2028; G03G 15/2085; G03G 15/2017; G03G 15/2025
See application file for complete search history.

(56) References Cited

U.S. PATENT DOCUMENTS 5,862,439 A * 1/1999 Pozzanghera ..... G03G 21/00 399/92
7,062,211 B2 6/2006 Baba et al.
2014/0270866 A1* 9/2014 Hatazaki ..... G03G 15/2025 399/327
2014/0270867 A1* 9/2014 Hatazaki ..... G03G 15/2025 399/327
2014/0270868 A1* 9/2014 Chiyoda ..... G03G 15/2025 399/327
2014/0314454 A1* 10/2014 Fukushi ..... G03G 15/2028 399/323

FOREIGN PATENT DOCUMENTS

JP 2004-212954 A 7/2004
JP 2007-199462 A 8/2007

* cited by examiner

*Primary Examiner* — Carla J Therrien
(74) *Attorney, Agent, or Firm* — Venable LLP

(57) ABSTRACT

An image forming apparatus includes an image forming unit that forms a toner image, a transfer portion that transfers the toner image onto a sheet, and a fixing unit that fixes the toner image to the sheet. A compressor outputs air based on a drive current supplied from a power source, and a detection portion detects the drive current. An ejection portion ejects the air output from the compressor, and a pipe supplies the air output from the compressor to the ejection portion. In addition, a determination unit determines a characteristic expression indicating a relationship between the drive current and an air pressure of the air based on a first detection result obtained by the detection portion when the air pressure is adjusted to a first predetermined value and a second detection result obtained by the detection portion when the air pressure is adjusted to a second predetermined value.

10 Claims, 11 Drawing Sheets

FIG. 8

| MEDIUM TYPE | SEPARATION OPERATION (MEDIUM BASIS WEIGHT CONDITION) | |
|---|---|---|
| | TO BE CARRIED OUT | NOT TO BE CARRIED OUT |
| FINE PAPER, RECYCLED PAPER | ≤209gsm | 209gsm< |
| COATED PAPER (SINGLE-SIDE-COATED, DOUBLE-SIDE-COATED) | ≤250gsm | 250gsm< |
| SPECIAL PAPER (EMBOSSED) | ≤209gsm | 209gsm< |
| SPECIAL PAPER (FILM, LABEL) | ≤300gsm | 300gsm< |

IMAGE FORMING APPARATUS HAVING A COMPRESSOR THAT OUTPUTS AIR TO SEPARATE A SHEET FROM A FIXING ROLLER

This application claims the benefit of Japanese Patent Application No. 2016-148357, filed Jul. 28, 2016, Japanese Patent Application No. 2016-148356, filed Jul. 28, 2016, and Japanese Patent Application No. 2016-202312, filed Oct. 14, 2016, which are hereby incorporated by reference herein in their entirety.

BACKGROUND OF THE INVENTION

Field of the Invention

The present invention relates to an image forming apparatus.

Description of the Related Art

In general, a fixing device configured to fix a toner image transferred onto a surface of a sheet is used in an image forming apparatus configured to form an image through use of an electrophotographic printing method. The fixing device is configured to pass the sheet having an unfixed toner image formed thereon through a nip portion of rollers, formed of a heating roller having a heated surface and a pressure roller, while applying heat and pressure to the sheet to melt the unfixed toner, to thereby fix the melted toner to the sheet. The unfixed toner on the sheet is melted while passing through the nip portion. There has been a fear that the sheet may be wound around the heating roller to cause a jam after passing through the fixing nip portion due to adhesion of the melted toner.

In order to prevent the jam, the related fixing device employs a separation claw that is brought into abutment with the heating roller, to peel off the sheet wound around the heating roller. When an image density is low or when an interval (hereinafter referred to as "margin") between an edge of the sheet and the image is large, it is easy for the separation claw to peel off the sheet from the heating roller. In a case of thin paper having a small basis weight, and, in particular, in a case of coated paper having a coated surface with a high-density image having a small margin from a leading edge and having large quantity of a toner born on the sheet, however, the adhesion of the melted toner with respect to the heating roller becomes larger. Therefore, it is difficult for the separation claw to enter between the sheet and the heating roller, causing a scratch on an edge of the sheet, and hence, an output sheet can no longer be used as a resultant object. In addition, the toner image is damaged due to the separation claw to be contacted with the melted toner image, and image quality of the output sheet being the resultant object deteriorates. Moreover, a heating roller surface is damaged due to the separation claw to be contacted with the heating roller, and the image quality of the output sheet deteriorates due to the damage.

In Japanese Patent Application Laid-Open No. 2004-212954 (corresponding to U.S. Pat. No. 7,062,211) or Japanese Patent Application Laid-Open No. 2007-199462, there is proposed a separation method for preventing damage to the image and to the heating roller. With this method, compressed air is ejected from a nozzle between the heating roller and a peeling guide plate arranged in a vicinity of the heating roller so as not to be brought into contact with the heating roller, to thereby separate a leading edge of the sheet stuck on the heating roller from the heating roller. After that, a peeling device peels off the entire sheet from the heating roller. In Japanese Patent Application Laid-Open No. 2004-212954, air compressed through use of an air pump (compressor) is output in a pulse shape by an electromagnetic valve to be blown onto a leading edge portion of the sheet, improving separability. In Japanese Patent Application Laid-Open No. 2007-199462, a pulse duty cycle or a cycle period used when the ejection is controlled in a pulse shape is changed, to thereby adjust an ejection air quantity to a proper value corresponding to a medium type.

There is also a method of using the compressed air for a purpose other than the separation of the sheet. There is a problem in that a scratch occurring on a heating roller surface layer due to an edge portion of the sheet causes an image failure having a streak shape on the resultant object, causing the quality of the resultant object to deteriorate. In order to cancel the scratch caused by the edge portion of the sheet, there is provided a cleaning roller configured to scrape the heating roller surface layer of the fixing device. It is important, however, to maintain a surface roughness of the cleaning roller at a constant level in order to continuously use the heating roller without causing an image failure.

Therefore, it is necessary to remove a resin and an adhering toner that occur when the cleaning roller scrapes the heating roller surface. In order to remove the resin and the adhering toner, a method of blowing the compressed air is employed. With this configuration, the surface roughness of the cleaning roller is maintained at a fixed level, and the heating roller is scraped with stability, to thereby allow the fixing device to be used with long life without causing a scratch on the heating roller surface.

When a pressure value of the compressed air does not fall within a normal range during operation, there is a fear that a jam ascribable to a separation failure occurs due to deterioration in separation performance of the sheet, or that an image failure ascribable to a fixing roller occurs due to lowering of the surface roughness of the cleaning roller. In addition, in order to detect a change in pressure or quantity of ejected air, it is necessary to separately provide a sensor and an accompanying mechanism that adversely increases a cost and a size of an apparatus.

SUMMARY OF THE INVENTION

An object of the present invention is to provide a construction capable of monitoring a value of a drive current being supplied to a compressor and calculating a characteristic expression for determining whether or not an air pressure of air being supplied from the compressor is normal.

In order to achieve the above-mentioned object, in one aspect, the present invention provides an image forming apparatus including an image forming unit configured to form a toner image, a transfer portion configured to transfer the toner image onto a sheet, a fixing unit configured to fix the toner image to the sheet, a compressor configured to output air based on a drive current supplied from a power source, a detection portion configured to detect the drive current, an ejection portion configured to eject the air output from the compressor, a pipe configured to supply the air output from the compressor to the ejection portion, and a determination unit configured to determine a characteristic expression indicating a relationship between the drive current and an air pressure of the air based on a first detection result obtained by the detection portion when the air pressure is adjusted to a first predetermined value and a second detection result obtained by the detection portion when the air pressure is adjusted to a second predetermined value.

Further features of the present invention will become apparent from the following description of exemplary embodiments with reference to the attached drawings.

BRIEF DESCRIPTION OF THE DRAWINGS

FIG. 8 is a table for showing a basis weight of a medium set by a user.

DESCRIPTION OF THE EMBODIMENTS

Preferred embodiments of the present invention will now be described in detail in accordance with the accompanying drawings.

<Description of System Configuration>

The following description is made by taking an electrophotographic image forming apparatus (laser beam printer) as an example. Characteristic points in terms of control, and, in particular, matters described in the appended claims, can also be applied, however, to an image forming apparatus of another method, for example, a sublimation type printer.

First Embodiment

Figure 1:
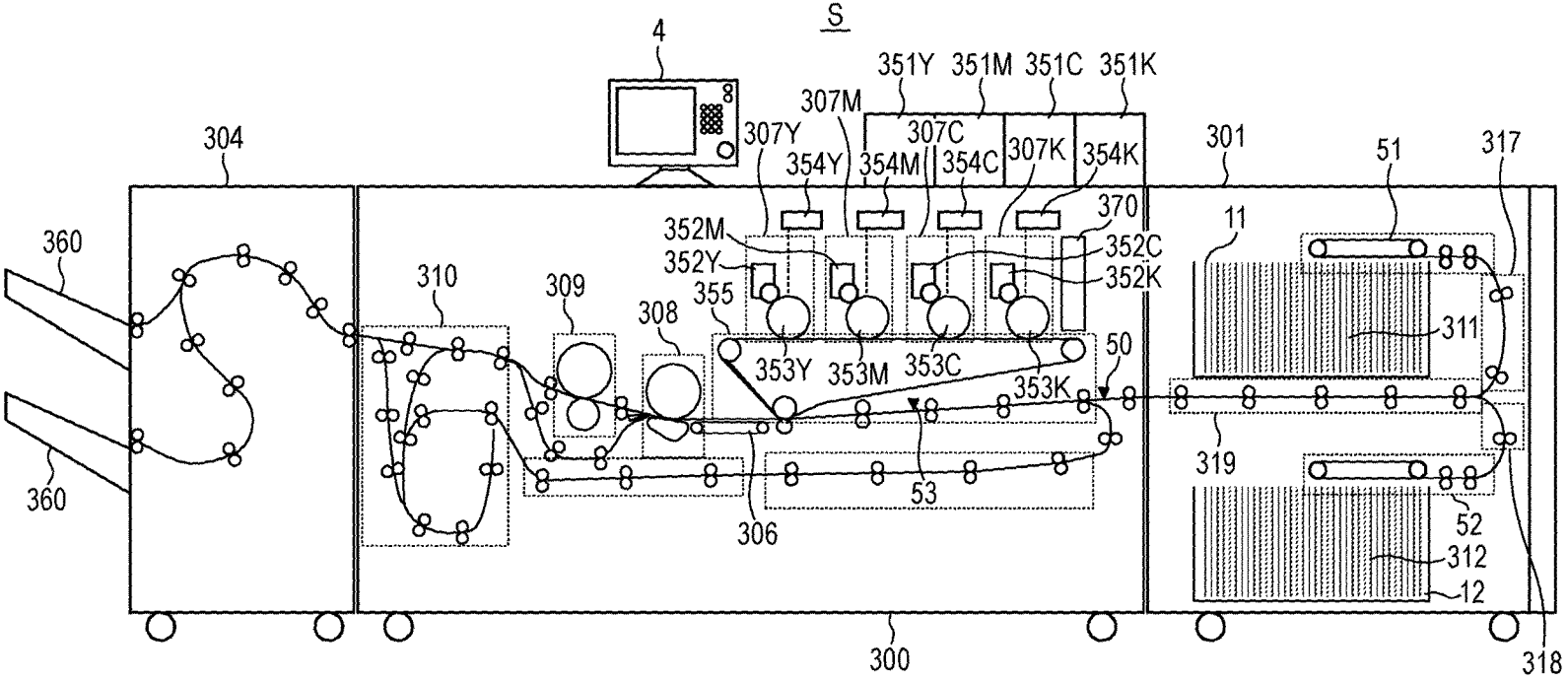
FIG. 1 is a sectional view for illustrating a configuration of an image forming system.

FIG. 1 is a sectional view for illustrating a configuration of an image forming system S to which an image forming apparatus according to a first embodiment of the present invention is applied. The image forming system S according to the first embodiment includes a sheet feeding apparatus 301 configured to feed a sheet (e.g., a paper), an image forming apparatus 300 configured to perform image formation, an operation portion 4 configured to present information to a user or to receive an operation from the user, and a post-processing apparatus 304. The post-processing apparatus 304 is configured to subject the sheet to desired post-processing (processing including folding, stapling, and punching) that is, for example, set by the user via the operation portion 4.

In the image forming apparatus 300 according to the first embodiment, for example, the sheet, onto which developer has been transferred, is pressurized by a heated rotary member to be fixed, or the sheet, onto which the developer has been transferred, is pressurized by a heated first rotary member to be fixed. In addition, the image forming apparatus 300 has a residual developer cleaned by a second rotary member arranged in contact with the first rotary member.

In the image forming system S illustrated in FIG. 1, operations of the sheet feeding apparatus 301 and the image forming apparatus 300 (image forming unit) are controlled by a single CPU 400, and the post-processing apparatus 304 is controlled by another CPU. The user uses the operation portion 4 or an external host PC (not shown) to set a job (processing settings for the sheet or image information transmitted from the external host PC). The external host PC is connected to the image forming system S through a network. Feeding and conveyance of the sheet, the image formation, and the post-processing are carried out based on the job, and a resultant object is output to be provided to the user. A series of processing performed in the image forming system S is described below.

In FIG. 1, the sheet feeding apparatus 301 includes two-stage sheet feeding portions 311 and 312. A containing portion 11 of the sheet feeding portion 311 and a containing portion 12 of the sheet feeding portion 312 are each configured to contain a sheet stack, and sheets are fed from the containing portions 11 and 12 as the need arises. A sheet feeding operation is performed by a sheet attracting/conveying portion 51 arranged in the sheet feeding portion 311 and a sheet attracting/conveying portion 52 arranged in the sheet feeding portion 312. In the first embodiment, a plurality of fans (not shown) are arranged in the sheet attracting/conveying portions 51 and 52 in order to control the air sheet feeding. During the sheet feeding operation, the fans are controlled so as to send air into space between the sheets inside the containing portion 11 or 12 from an upstream side in a conveyance direction, to thereby loosen the sheets.

The sheet is attracted to an endless belt by a fan for attracting a sheet that is arranged inside the endless belt within the sheet attracting/conveying portions 51 and 52. Then, the sheets are separated from one another to be fed and conveyed. The sheet that has been fed and conveyed from an upper sheet feeding portion 311 is continuously conveyed by an upper conveyance portion 317, while the sheet that has been fed and conveyed from a lower sheet feeding portion 312 is continuously conveyed by a lower conveyance portion 318. The sheet fed from the upper sheet feeding portion 311 or the lower sheet feeding portion 312 is conveyed to the image forming apparatus 300 via a joined conveyance portion 319, into which the upper conveyance portion 317 is joined.

A sheet detection sensor (not shown) of a reflecting optical type is provided on each conveying path. The sheet detection sensor is configured to detect passage of a leading edge or a trailing edge of the sheet, to thereby detect a position of the sheet on each conveying path. After being conveyed to the joined conveyance portion 319, the sheet is delivered to the image forming apparatus 300. Each of the conveyance portions includes a stepping motor (not shown) for conveyance. The driving of the stepping motors is controlled to mechanically transmit the driving of the stepping motor provided to each conveyance portion to a conveyance roller of each portion. The conveyance roller of each portion is thus rotated, to thereby convey the sheet.

The sheets in each of the containing portions 11 and 12 are separated one by one to be fed and to be conveyed based on sheet request information of the job specified by the user. The sheet feeding apparatus 301 successively conveys the sheet to the image forming apparatus 300. The sheet feeding apparatus 301 finishes the sheet feeding operation when the requested number of sheets are fed.

The operation portion 4 and hopper portions 351Y, 351M, 351C, and 351K, configured to contain toner bottles of the colors of yellow (Y), magenta (M), cyan (C), and black (K), respectively, are arranged above the image forming apparatus 300. The user uses the operation portion 4 to specify medium information, including a size, a basis weight, a type (fine paper, coated paper, recycled paper, or special paper), and the like, of the sheet and the post-processing to be performed after the sheet delivery, to make an operation setting of image quality, or the like, for the image forming system S, or to make a status setting for a fixing device 309.

The user sets the medium information, including the size, the basis weight, the type (fine paper, coated paper, recycled paper, or special paper), and the like, of the sheet based on the sheet stored in each of the sheet feeding portions 311 and 312 of the sheet feeding apparatus 301. The image forming apparatus 300 receives the sheets one by one from the sheet feeding apparatus 301. The CPU 400 performs the image formation by changing image formation conditions based on the setting information, including the sheet size, the basis weight, and the type that have been specified via the operation portion 4.

After receiving the sheet from the connected sheet feeding apparatus 301, the image forming apparatus 300 controls each conveyance portion to convey the sheet. When the sheet is detected by a registration sensor 50, the image forming apparatus 300 starts performing an image forming operation based on received image data. Semiconductor lasers included in laser scanner units 354Y, 354M, 354C, and 354K are turned on and have light intensity controlled. At the same time, a scanner motor configured to control rotation of a polygon mirror (not shown) is controlled. Then, a latent image is formed on each of photosensitive drums 353Y, 353M, 353C, and 353K inside image forming portions 307Y, 307M, 307C, and 307K, respectively, by the laser light based on the image data.

Developing portions 352Y, 352M, 352C, and 352K, to which the toners of the respective colors are supplied from the toner bottles 351Y, 351M, 351C, and 351K, are configured to develop the latent images on the photosensitive drums 353Y, 353M, 353C, and 353K with the toners of the respective colors. The photosensitive drums 353Y, 353M, 353C, and 353K are configured to primarily transfer each of the developed toner images onto an intermediate transfer belt 355 (transfer portion). The primary transfer is performed for the respective colors of Y, M, C, and K, and the toner images are successively transferred so that the positions of the respective colors match one another on the intermediate transfer belt 355. The transferred toner images are secondarily transferred onto the sheet, to thereby form a toner image on the sheet.

The image forming apparatus 300 includes an image adjusting portion 370 for density adjustment and registration adjustment of the toner images of the respective colors. The image adjusting portion 370 is configured to detect a density patch and a registration patch on the intermediate transfer belt 355. The laser light amount and the latent image position are adjusted based on a detection result thereof.

There is a registration control portion in the image forming apparatus 300 between a receiving position of the sheet and a position immediately before a secondary transfer position. The registration control portion is configured to perform, without stopping the sheet, correction of a skew feed amount of the sheet for the sheet located immediately before the transfer position, and to perform sheet conveyance control involving fine adjustment and matching between the toner image formed on the intermediate transfer belt 355 and a sheet leading edge position.

At this time, the sheet leading edge position is detected by an image reference sensor 53, and the leading edge is registered. The sheet subjected to the secondary transfer is conveyed to a first fixing portion 308 (fixing unit) by a belt conveyance portion 306. The first fixing portion 308 is configured to apply heat and pressure to the sheet to melt the toner and to fix the melted toner to the sheet.

The sheet is conveyed to the second fixing portion 309 depending on the medium type, such as thick paper, plain paper, or coated paper having a basis weight of equal to or greater than 157 gsm. Refixation is performed by the second fixing portion 309, to thereby be able to improve fixability of the toner or to adjust gloss.

A controlled temperature and a pressure force of fixation performed by the first fixing portion 308 and the second fixing portion 309 (fixing unit) are determined based on the medium information set by the user via the operation portion 4. Although not shown in FIG. 1, a separation ejection portion 205 configured to eject compressed air for separation and a peeling guide plate 204 are installed in the first fixing portion 308. The separation ejection portion 205 and the peeling guide plate 204 function as a separation air portion.

In the first fixing portion 308, a first refreshing roller 210, a first cleaning ejection portion 211, and a first cleaning duct 212 are installed. The first refreshing roller 210 is configured to rub a heating roller surface to refresh a roller surface having a scratch. The first cleaning ejection portion 211 and the first cleaning duct 212 are configured to peel off a resin material and a toner adhering to a refreshing roller surface from a roller surface layer by the compressed air. Details thereof are described later with reference to FIG. 2A and FIG. 2B.

In a case in which an image is printed on a back surface of the sheet, the sheet subjected to the fixation is conveyed to a sheet surface reversal conveyance portion 310, and then the image is formed on the back surface of the sheet. In a case in which the printing is to end, the sheet subjected to the fixation is continuously conveyed downstream to the post-processing apparatus 304 via the sheet surface reversal conveyance portion 310.

The post-processing apparatus 304 is connected to the downstream side of the image forming apparatus 300. The CPU 400 notifies to the post-processing apparatus 304 processing information on the desired post-processing (folding, stapling, and punching) set by the user via the operation portion 4. The post-processing apparatus 304 receives the sheet subjected to the image formation from the image forming apparatus 300. After that, the post-processing apparatus 304 subjects the sheet to the desired post-processing set by the user. Then, the post-processing apparatus 304 successively outputs the sheets (sheet stack) subjected to the post-processing to any one of delivery trays 360 as the resultant object, and provides the resultant object to the user.

Figure 2A:
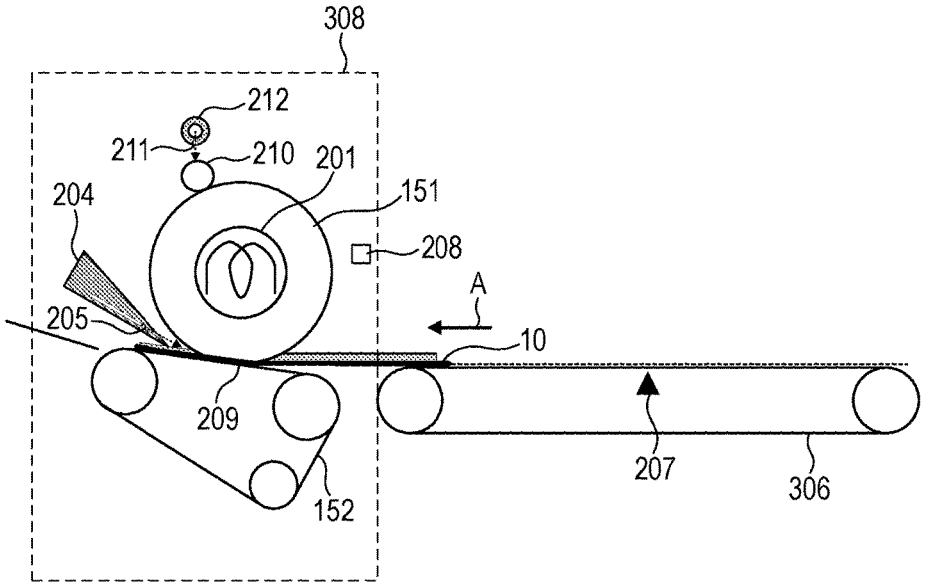
FIG. 2A is a sectional view for illustrating a first fixing portion.
Figure 2B:
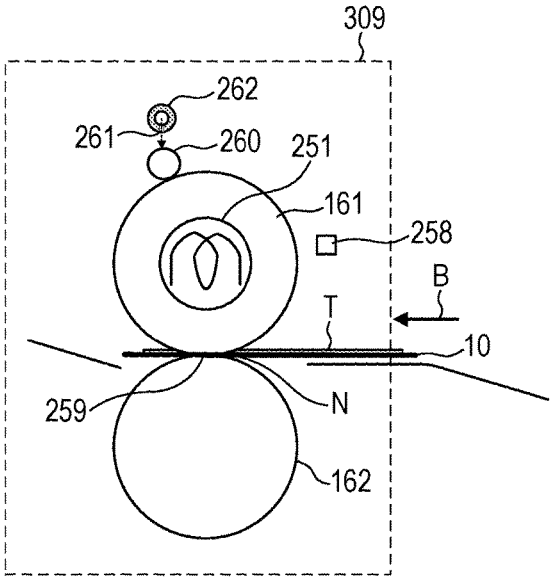
FIG. 2B is a sectional view for illustrating a second fixing portion.

FIG. 2A and FIG. 2B are sectional views for illustrating the first fixing portion 308 and the second fixing portion 309 configured to perform thermal fixing processing, and illustrated in FIG. 1. Details of the first fixing portion 308 and the second fixing portion 309 configured to eject the compressed air are described below.

In FIG. 2A, the first fixing portion 308 includes a heating roller 151 including a heater 201 for heating, and a pressurizing belt 152 arranged in a position opposed to the heating roller 151 and configured to apply pressure to a surface of the heating roller 151. In order to control the heater 201, a thermistor 208 for temperature detection is arranged in a vicinity of the surface of the heating roller 151. A control device (not shown) determines turning on or off the heater 201 based on a detection result obtained by the thermistor 208.

A sheet 10 having a surface bearing an unfixed toner is conveyed toward a direction indicated by an arrow A, and is heated and pressurized at a nip portion 209 between the heating roller 151 and the pressurizing belt 152. With this configuration, the unfixed toner is fused and fixed to the sheet 10. In short, the toner image on the sheet 10 is heated and pressurized by the rotary member (the heating roller 151) to be fixed to the sheet 10.

The peeling guide plate 204 is installed in a vicinity of a sheet delivery portion of the heating roller 151. That is, the peeling guide plate 204 is installed on a sheet delivery side (in a direction for delivering the sheet 10 that has passed through the nip portion 209) of the heating roller 151. In order to eject the compressed air into a gap between the peeling guide plate 204 and the heating roller 151, the separation ejection portion 205 is arranged on the peeling guide plate 204. A transmissive sheet detection sensor 207 is arranged inside the conveyance belt 306 configured to convey the sheet 10 toward the first fixing portion 308. The sheet detection sensor 207 is used to generate a timing to eject the compressed air to be blown onto a sheet leading edge from the separation ejection portion 205. The compressed air is ejected onto the leading edge of the sheet 10 at a timing when a time period required for the leading edge of the sheet 10 to pass through the nip portion 209 has elapsed since the sheet detection sensor 207 detects the leading edge of the sheet 10.

The first refreshing roller 210, configured to rub the surface of the heating roller 151 to refresh the roller surface having a scratch, is arranged in contact with the heating roller 151. When the first refreshing roller 210 rubs the surface layer of the heating roller 151, the resin material and the toner on the roller surface layer adhere to the surface of the first refreshing roller 210. The surface of the first refreshing roller 210 is adversely leveled with an adhering substance remaining on the surface, causing refreshing performance on the surface of the heating roller 151 to deteriorate. Therefore, the first cleaning ejection portion 211, configured to perform a cleaning operation for intermittently ejecting the compressed air to peel off the adhering substance, is installed in a position opposed to the first refreshing roller 210. The first cleaning ejection portion 211 is formed in the first cleaning duct 212 being a hollow pipe. On the first cleaning duct 212, ejection ports are arrayed in the position opposed to the heating roller 151 to form the first cleaning ejection portion 211. The compressed air is ejected from the first cleaning ejection portion 211, to thereby peel off the resin material and the toner adhering to the surface of the first refreshing roller 210 from the roller surface layer.

The second fixing portion 309 illustrated in FIG. 2B uses the heated first rotary member to pressurize and fix the sheet 10 onto which the developer has been transferred, and a second rotary member arranged in contact with the first rotary member to clean the residual developer. The second fixing portion 309 of FIG. 2B includes a heating roller 161, including a heater 251 for heating, and a pressure roller 162 arranged in a position opposed to the heating roller 161. The pressure roller 162 is configured to rotate in a direction reverse to that of the heating roller 161. In order to control the heater 251, a thermistor 258 for temperature detection is arranged in a vicinity of a surface of the heating roller 161. The CPU 400 determines turning on or off the heater 251 based on a detection result obtained by the thermistor 258. The above-mentioned control is the same as that of the first fixing portion 308.

The sheet 10 that has been primarily fixed by the first fixing portion 308 is continuously conveyed toward a direction indicated by an arrow B. Then, the refixation is performed at a nip portion 259 formed between the heating roller 161 and the pressure roller 162. With this configuration, the fixability of the toner is improved, or the gloss of the fixed toner image on the sheet 10 is adjusted.

In the same manner as in the first fixing portion 308 configured to perform the thermal fixing processing, a second refreshing roller 260, configured to rub the surface of the heating roller 161 to refresh the roller surface having a scratch, is installed. In the second fixing portion 309, a second cleaning duct 262 is installed. The second cleaning duct 262 is a hollow pipe and has a second cleaning ejection portion 261 formed therein so as to be opposed to the second refreshing roller 260. The configurations of the second refreshing roller 260, the second cleaning ejection portion 261, and the second cleaning duct 262 are equivalent to those of the first fixing portion 308, and hence, descriptions thereof are omitted. The first refreshing roller 210 and the second refreshing roller 260 each function as a cleaning unit configured to collect a substance adhering to a rotary member surface, that is, a substance adhering to the heating roller surface. The first cleaning ejection portion 211 and the first cleaning duct 212, and the second cleaning ejection portion 261 and the second cleaning duct 262 function as a cleaning air ejection portion, respectively.

Figure 3:
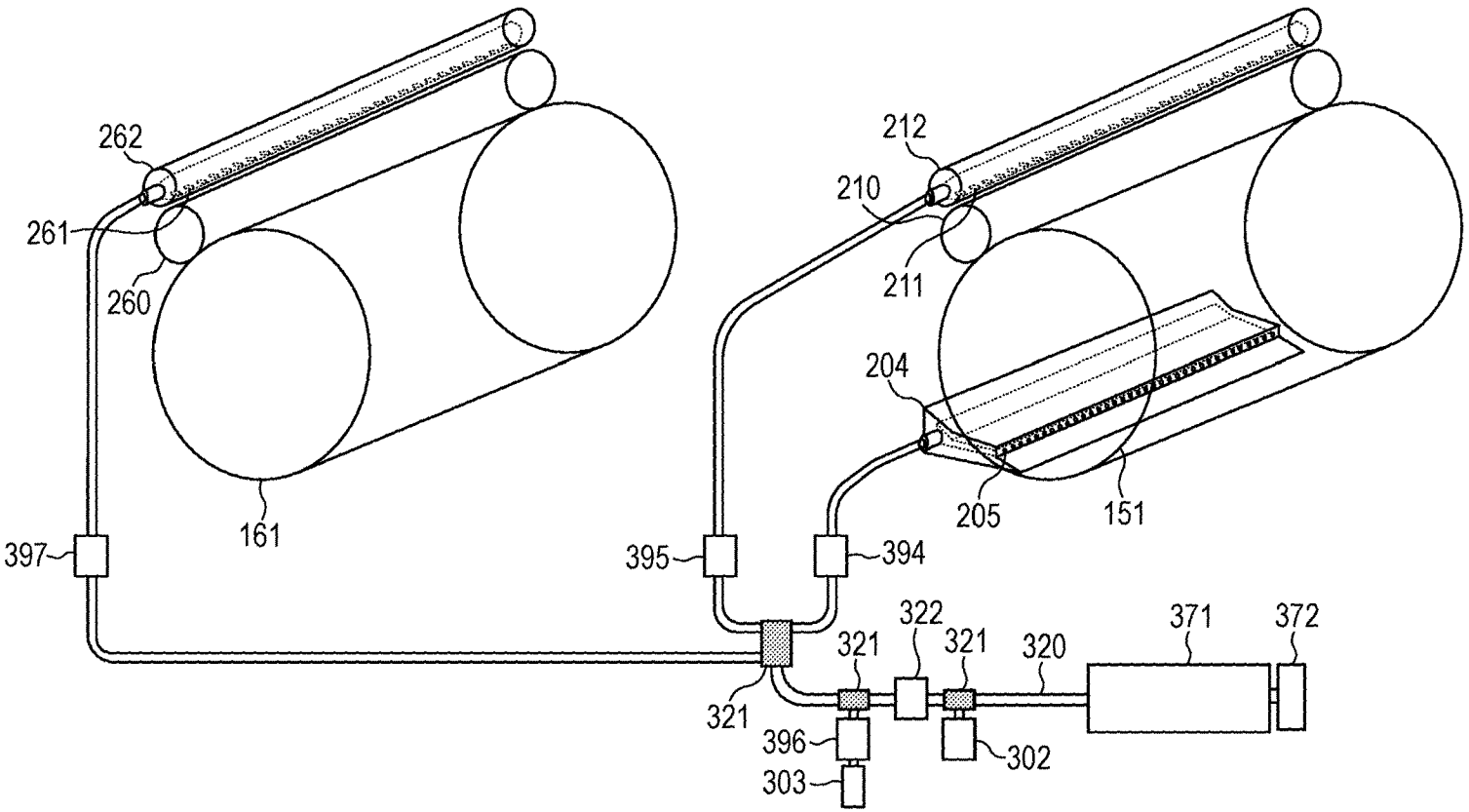
FIG. 3 is an illustration of an arrangement configuration of a separation ejection portion, a first cleaning ejection portion, and a second cleaning ejection portion.

FIG. 3 is an illustration of an arrangement configuration of the separation ejection portion 205, the first cleaning ejection portion 211, and the second cleaning ejection portion 261 illustrated in FIG. 2A and FIG. 2B. The first fixing portion 308 and the second fixing portion 309 are different in that the first fixing portion 308 includes the peeling guide plate 204. The configurations of the first cleaning ejection portion 211 and the second cleaning ejection portion 261 are, however, equivalent to each other, and hence, the first fixing portion 308 is described, while the description of the second fixing portion 309 is omitted.

In FIG. 3, a compressor 371 using an AC motor is described, but another configuration may be employed.

The compressor 371 is configured to compress air sucked through an input filter 372 being a detachably attachable air filter to generate compressed air. The compressor 371 is further configured to eject the compressed air into a pipe 320 connected by a coupling member 321. The input filter 372 is arranged in order to prevent the interior of a compressor from deteriorating due to suction of a foreign matter, to prevent the compressor from breaking, and to suppress a sucking sound of the compressor 371 during the suction of air.

An atmosphere release valve 302 (first release valve) is an electromagnetic valve configured to electrically open or to electrically close a valve in order to release air inside the pipe 320 to outside air so as to equalize the air pressure inside the pipe 320 with the atmospheric pressure when the compressor 371 is activated. The compressor 371 needs to lower an ejection-side load on the compressor 371 by equalizing the air pressure inside the pipe 320 with the atmospheric pressure at a time of activation thereof.

A pressure gauge 322 is configured to measure and display the air pressure inside the pipe 320. A pressure adjustment valve 396 is configured to adjust the pressure of the compressed air ejected from the compressor 371. The pressure adjustment valve 396 is capable of manually adjusting the pressure based on a measurement value of the pressure gauge 322 so as to maintain the pressure inside the pipe 320 at a constant level.

A relief valve 303 is connected to a downstream side of the pressure adjustment valve 396 and is configured to release unnecessary compressed air having a pressure of equal to or greater than a pressure adjustment value to the atmosphere. The pressure adjustment valve 396 is adjusted so that the pressure adjustment value becomes 0.3 MPa when the apparatus is factory-shipped.

A separation electromagnetic valve 394 (second release valve) is configured to open or to close the valve, to thereby switch whether or not to send the compressed air inside the pipe 320 to the separation ejection portion 205 via the interior of the peeling guide plate 204. That is, the separation electromagnetic valve 394 is brought into an open state at a predetermined timing. With this configuration, the compressed air reaches the separation ejection portion 205 being the arrayed ejection ports via the interior of the peeling guide plate 204, and is ejected to space between the heating roller 151 and the sheet 10.

As in the separation electromagnetic valve 394, a first cleaning electromagnetic valve 395 (second release valve) is configured to open or to close the valve, to thereby switch whether or not to send the compressed air inside the pipe 320 to the first cleaning ejection portion 211 via the interior of the first cleaning duct 212. A second cleaning electromagnetic valve 397 (second release valve) of the second fixing portion 309 is also configured to open or to close the valve, to thereby switch whether or not to send the compressed air to the second cleaning ejection portion 261 via the interior of the second cleaning duct 262.

After the compressor 371 is activated, the atmosphere release valve 302, the separation electromagnetic valve 394, the first cleaning electromagnetic valve 395, and the second cleaning electromagnetic valve 397 are all brought into a closed state. With this configuration, the pressure inside the pipe 320 is maintained at a pressure set by the pressure adjustment valve 396.

Figure 4:
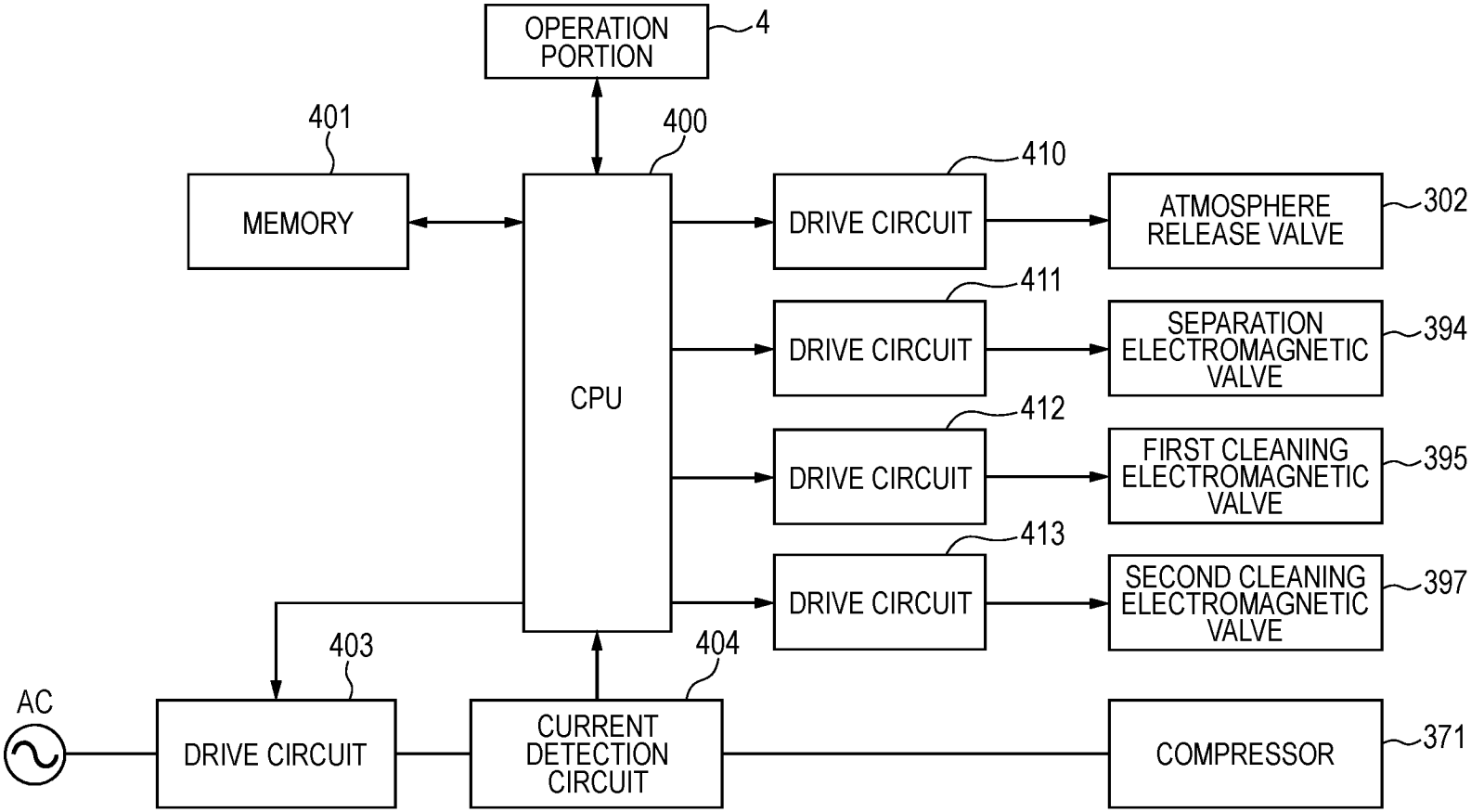
FIG. 4 is a block diagram for illustrating a configuration of a control portion configured to control driving of the separation ejection portion, the first cleaning ejection portion, and the second cleaning ejection portion.

FIG. 4 is a block diagram for illustrating a drive control portion for the separation ejection portion 205, the first cleaning ejection portion 211, and the second cleaning ejection portion 261, illustrated in FIG. 3. The image forming apparatus 300 includes the CPU 400, a memory 401, a compressor drive circuit 403, a current detection circuit 404 (detection portion), and drive circuits 410 to 413. The CPU 400 is configured to centrally control the respective functional components included in the image forming apparatus 300.

The compressor drive circuit 403 is configured to drive the compressor 371 based on a control signal output from the CPU 400. Specifically, the compressor drive circuit 403 performs AC supply to the compressor 371 based on an ON signal output from the CPU 400 to start driving the compressor 371, and interrupts the AC supply based on an OFF signal to stop driving the compressor 371. In addition, the current detection circuit 404 is arranged between the compressor drive circuit 403 and the compressor 371. The current detection circuit 404 detects a current value of a drive current flowing into the compressor 371.

In FIG. 4, the CPU (processor) 400 is connected to the nonvolatile memory 401, and is capable of causing the memory 401 to store, for example, various kinds of parameter data for controlling the operation of the image forming apparatus 300. The CPU 400 is connected to the operation portion 4 that is configured to display a user interface (UI) screen for receiving an operation instruction for the image forming apparatus 300. The setting information specified by the user is notified to the CPU 400, and the CPU 400 notifies an apparatus state to the user via the UI screen.

The CPU 400 is configured to output control signals to the drive circuits 403, 410, 411, 412, and 413 for driving the compressor 371, the atmosphere release valve 302, the separation electromagnetic valve 394, the first cleaning electromagnetic valve 395, and the second cleaning electromagnetic valve 397, respectively. The drive circuit 403 for the compressor 371 is configured to drive the compressor 371 based on the control signal output from the CPU 400. Specifically, when receiving the ON signal from the CPU 400, the drive circuit 403 supplies an AC to the compressor 371, to thereby drive the compressor 371. When receiving the OFF signal, the drive circuit 403 interrupts the AC supply to stop driving the compressor 371.

The current detection circuit 404 is arranged between the drive circuit 403 and the compressor 371. The current detection circuit 404 is configured to detect the drive current flowing into the compressor 371. The current detection circuit 404 is configured as a current transformer, and is configured to rectify and to amplify its output, and to convert the resultant into a voltage signal. The voltage signal obtained by the conversion is notified to the CPU 400 as a current detection signal having a voltage value linearly changing in succession based on the drive current of the compressor 371. The current detection signal is input to an AD converter of the CPU 400 to be digitally converted. This allows the CPU 400 to detect the drive current of the compressor 371.

The CPU 400 is configured to cause the drive circuit 410 to control the opening and closing of the atmosphere release valve 302. The CPU 400 is further configured to cause the drive circuit 411 to control the opening and closing of the separation electromagnetic valve 394. The CPU 400 is further configured to cause the drive circuit 412 to control the opening and closing of the first cleaning electromagnetic valve 395. The CPU 400 is further configured to cause the drive circuit 413 to control the opening and closing of the second cleaning electromagnetic valve 397. The respective kinds of electromagnetic valves each have a solenoid inside the electromagnetic valve that is driven or stopped based on the ON signal or the OFF signal output from the CPU 400 to open the valve or to close the valve.

The separation electromagnetic valve 394, the first cleaning electromagnetic valve 395, and the second cleaning electromagnetic valve 397 are each of a normally closed type (NC type) for opening the valve based on the ON signal and closing the valve based on the OFF signal. The atmosphere release valve 302 is of a normally open type (NO type) for closing the valve based on the ON signal and opening the valve based on the OFF signal.

Figure 5:
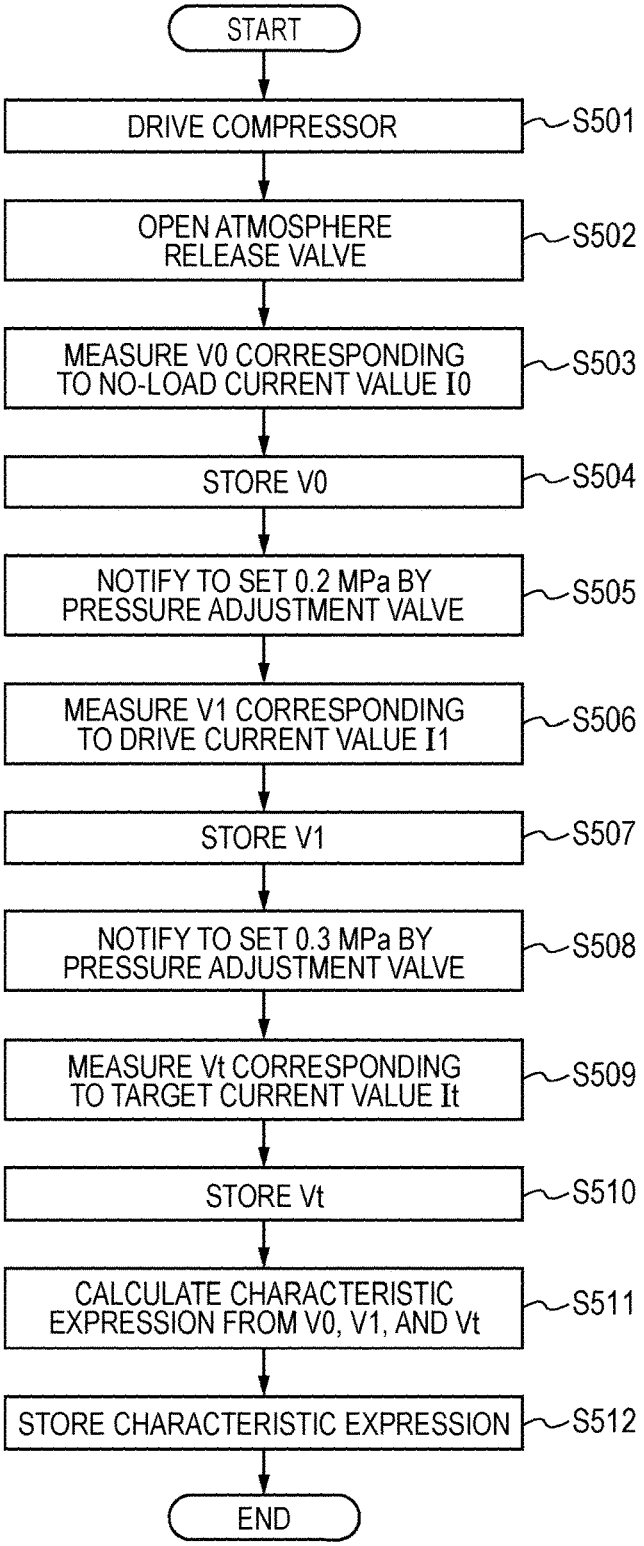
FIG. 5 is a flowchart for illustrating a method of controlling an image forming apparatus according to a first embodiment of the present invention.

FIG. 5 is a flowchart for illustrating processing for calculating, by the image forming apparatus 300, a characteristic expression representing a correspondence relationship between an air pressure of the compressor 371 and the current detection signal. In this processing example, a characteristic expression for determining an ejection air pressure and the current value is calculated. Each step is achieved mainly by the CPU 400 executing a stored control program. This processing is carried out based on the user's instruction. For example, when installing the image forming apparatus 300, a service person carries out this processing in order to store the characteristic expression in the memory 401.

In a standby state after power of the image forming apparatus 300 is turned on, the compressor 371 is driven when the operation start of the compressor 371 is set via the operation portion 4 (Step S501). The compressor 371 is activated by opening the atmosphere release valve 302. After the activation, the atmosphere release valve 302 is closed to keep the compressor 371 in a driven state. At this time, the pressure adjustment valve 396 is manually adjusted in advance by an operator so as to achieve a state of a sufficiently low pressure. Then, the CPU 400 opens the atmosphere release valve 302 (Step S502). With this processing, the air pressure on the ejection side of the compressor 371 becomes equivalent to 0 MPa, and the driven state of the compressor 371 becomes a no-load state.

Now, the CPU 400 samples and measures the current detection signal corresponding to a no-load current value I0 (third detection result) of the compressor 371 that has been brought into the no-load state via the current detection circuit 404 for a predetermined time period (Step S503). Then, the CPU 400 measures a no-load voltage V0 corresponding to the no-load current value I0 obtained by averaging a plurality of sampling results, and stores the value in the memory 401 (Step S504).

Subsequently, the CPU 400 brings the atmosphere release valve 302 into a valve-closed state again, and then notifies to adjust the ejection air pressure to 0.2 MPa via the operation portion 4 (Step S505). Then, the operator uses the pressure adjustment valve 396 to adjust the ejection air pressure so that an indicated value of the pressure gauge 322 becomes 0.2 MPa. The operator sets the fact that the adjustment has been finished via the operation portion 4. After receiving the setting that the adjustment has been finished, the CPU 400 measures a drive current value I1 (second detection result) of the compressor 371 obtained when 0.2 MPa (second predetermined value) is set in the same manner as in the case of the no-load current value I0 (Step S506). Then, the CPU 400 measures a 0.2-MPa voltage V1 corresponding to the drive current value I1, and stores the value in the memory 401 (Step S507).

Subsequently, the CPU 400 notifies to adjust the ejection air pressure to 0.3 MPa via the operation portion 4 (Step S508). The operator operates the pressure adjustment valve 396 to adjust the ejection air pressure so that the indicated value of the pressure gauge 322 becomes 0.3 MPa. Then, the operator sets the fact that the adjustment has been finished via the operation portion 4. After receiving the setting of the fact that the adjustment has been finished, the CPU 400 measures a drive current value It (first detection result) of the compressor 371 obtained when 0.3 MPa (first predetermined value) is set in the same manner as in the case of the no-load current value I0 (Step S509). Then, the CPU 400 measures a 0.3-MPa voltage Vt corresponding to the drive current value It, and stores the value in the memory 401 (Step S510).

Then, the CPU 400 stops driving the compressor 371, and calculates the characteristic expression of the acquired voltages V0, V1, and Vt and the air pressure on the ejection side by an approximation equation (Step S511). The CPU 400 stores the calculated characteristic expression in the memory 401 (Step S512), and brings the processing to an end.

Figure 6A:
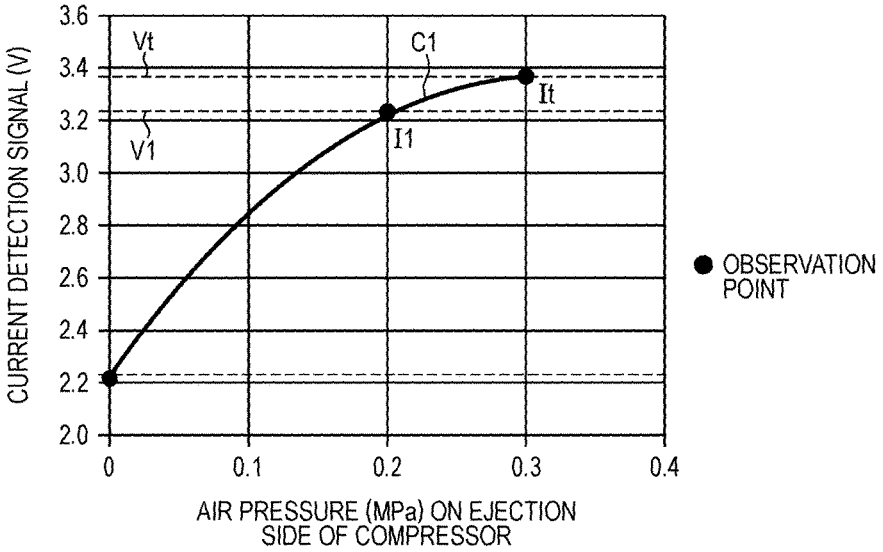
FIG. 6A is a graph of a characteristic for showing a correspondence between an air pressure of ejected air and a compressor detection current value.
Figure 6B:
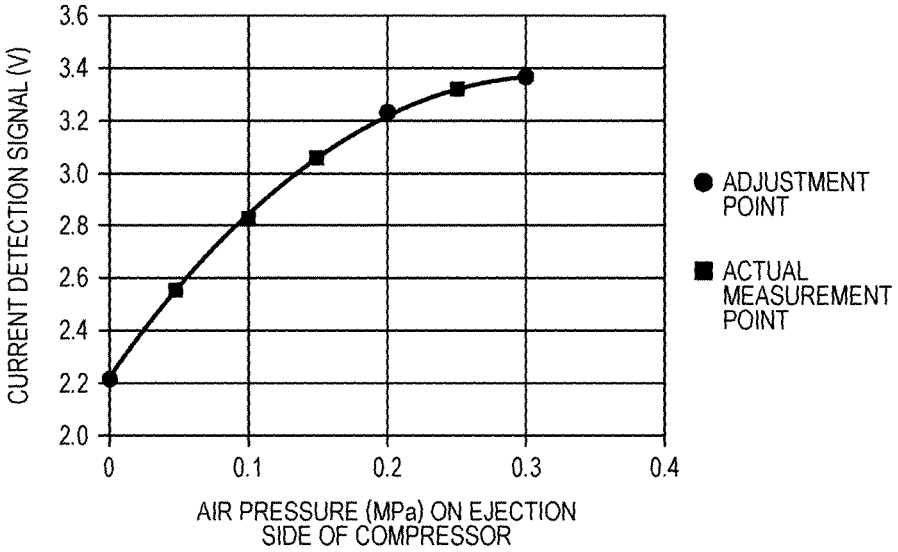
FIG. 6B is a graph of a characteristic for showing a correspondence between the air pressure of the ejected air and the compressor detection current value.

FIG. 6A and FIG. 6B are each a graph of a characteristic for showing a correspondence between the ejection air pressure at the fixing portions 308, 309 illustrated in FIG. 2A and FIG. 2B and a compressor drive current detection signal to be detected. A graph for showing the characteristic expression calculated by the flow illustrated in FIG. 5 is taken as a representative example. In FIG. 6A and FIG. 6B, the horizontal axis indicates the air pressure (ejection air pressure) (MPa) on the ejection side of the compressor 371, and the vertical axis indicates the current detection signal (V).

In FIG. 6A, an air pressure characteristic C1 indicates a result obtained by performing quadratic polynomial approximation based on three values of V0, V1, and Vt at respective measurement points (observation points) corresponding to the no-load current value I0, the drive current value I1, the drive current value It, respectively. FIG. 6B is a graph obtained by plotting actual measurement results adjusted to the air pressures on the ejection side that are different from adjustment points, as actual measurement points. In FIG. 6B, a result corresponding to the characteristic expression derived based on a measurement result of the drive current of the compressor 371 is shown.

In the first embodiment, the characteristic expression is calculated from the values of the air pressures associated with observed values at three points (measurement points I0, I1, and It) and the values of drive currents at the three points detected by the current detection circuit 404 at that time. This allows the characteristic expression for determining a deterioration state of the compressor 371 to be calculated with a small amount of arithmetic operation processing without increasing the number of measurement points. In this case, of the observed values at the three points, the value of the air pressure at one point (I0) is 0. The values of the air pressures at the other two points (I1 and It) are values (0.2 MPa to 0.3 MPa) for determining a range of a steady air pressure to be output by the compressor 371.

As described above, the pressure on the ejection side of the compressor 371 is adjusted so as to become predetermined pressures at two or more points in addition to the point in the no-load state, and the drive current of the compressor 371 at each of those times is measured. The characteristic expression between the pressure on the ejection side of the compressor 371 and the drive current is calculated based on the measurement result. With this configuration, it is possible to compare a result of sampling and measuring the drive current by the CPU 400 with the characteristic expression, and to estimate the air pressure on the ejection side with high accuracy based on a result of the comparison.

This enables the notification of whether or not a stable air pressure is being supplied from the compressor 371 with an inexpensive and simple configuration. In addition, it is possible to prevent reduction in life of a fixing roller (e.g., the heating rollers 151, 161) due to deterioration in separation performance or cleaning performance ascribable to pressure abnormality.

Second Embodiment

When a pressure value of the compressed air does not fall within a normal range during the operation, as described above, there is a fear that a jam ascribable to a separation failure occurs due to deterioration in separation performance of the sheet 10, or that an image failure ascribable to the fixing roller (e.g., the heating rollers 151, 161) occurs due to lowering of surface roughness of a cleaning roller (e.g., the first refreshing roller 210 or the second refreshing roller 260).

In general, the compressor 371 includes a filter 372 in order to prevent a foreign matter from flowing into the compressor 371 from an air input side thereof. The filter 372 is stained and deteriorates after a long period of use, and hence, an air quantity on the input side is reduced, adversely leading to reduction of the air pressure on the ejection side. In order to detect a change in air pressure or air quantity, it is necessary to separately provide a sensor and an accompanying mechanism that adversely increases a cost and a size of an apparatus.

In order to solve the above-mentioned problem, an image forming apparatus 300 according to a second embodiment of the present invention determines whether or not the air pressure of the air to be output from the compressor 371 is in a lowered state with a simple configuration. In the following description of the second embodiment, different points from those of the first embodiment are described, and descriptions of the components described in the first embodiment are omitted. Unless otherwise described, like components denoted by like reference symbols provide substantially the same operations and functions, and actions and effects thereof are also substantially the same.

Figure 7:
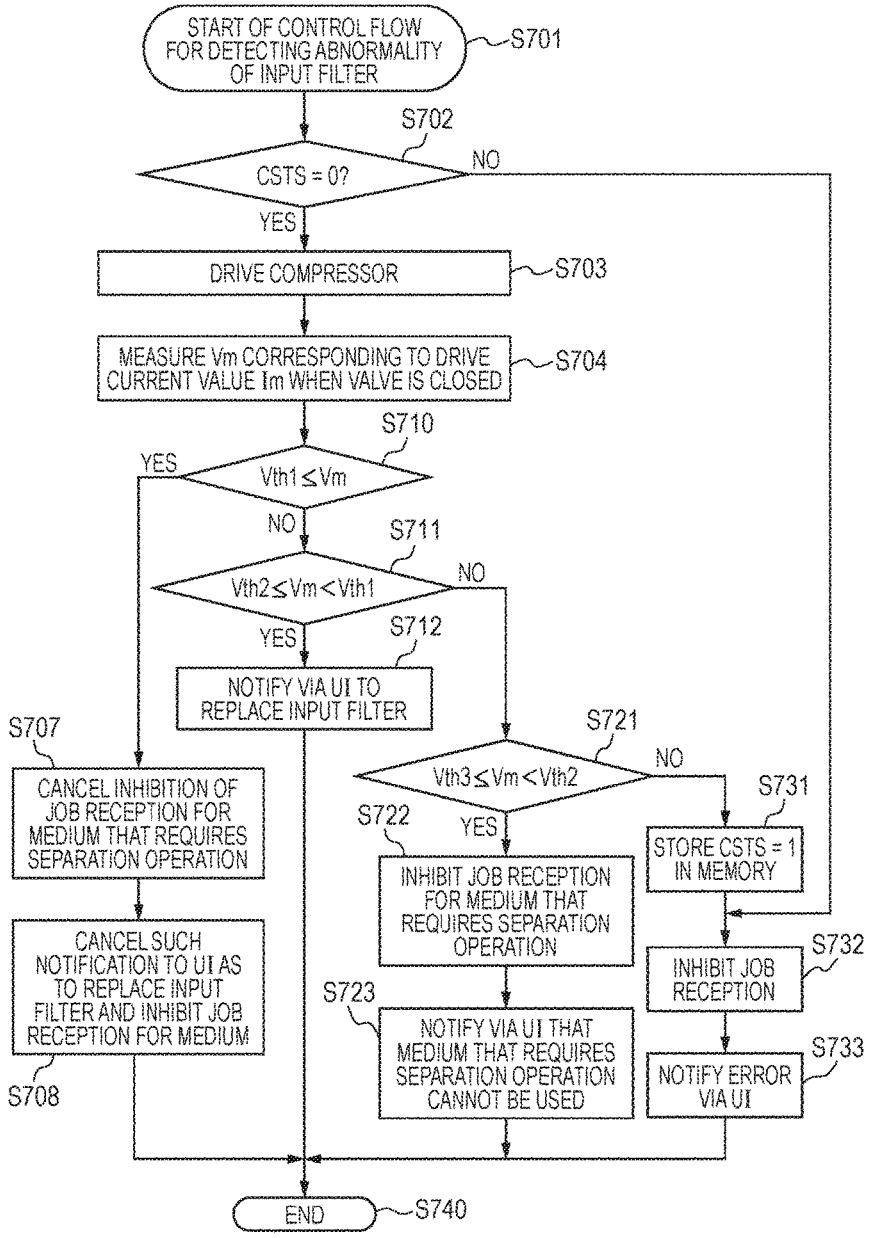
FIG. 7 is a flowchart for illustrating a method of controlling an image forming apparatus according to a second embodiment of the present invention.

The second embodiment relates to control for detecting abnormality of an input filter 372 that is performed when the air pressure on the ejection side is lowered due to the deterioration of the input-side filter 372 of the compressor 371. FIG. 7 is a flowchart for illustrating an example of a processing procedure for determining, by the image forming apparatus 300, the deterioration of the input-side filter 372 based on the characteristic expression derived in the processing illustrated in FIG. 5. Each step is achieved mainly by the CPU 400 (determination unit) executing the stored control program. Now, a description is made of processing for comparing and determining whether or not a voltage value Vm derived from the characteristic expression falls within a range of voltage threshold values Vth1 to Vth3, and determining whether or not the air pressure of the compressor 371 has been lowered based on a result of the determination by software. This determination processing is carried out when the compressor is driven.

Figure 9:
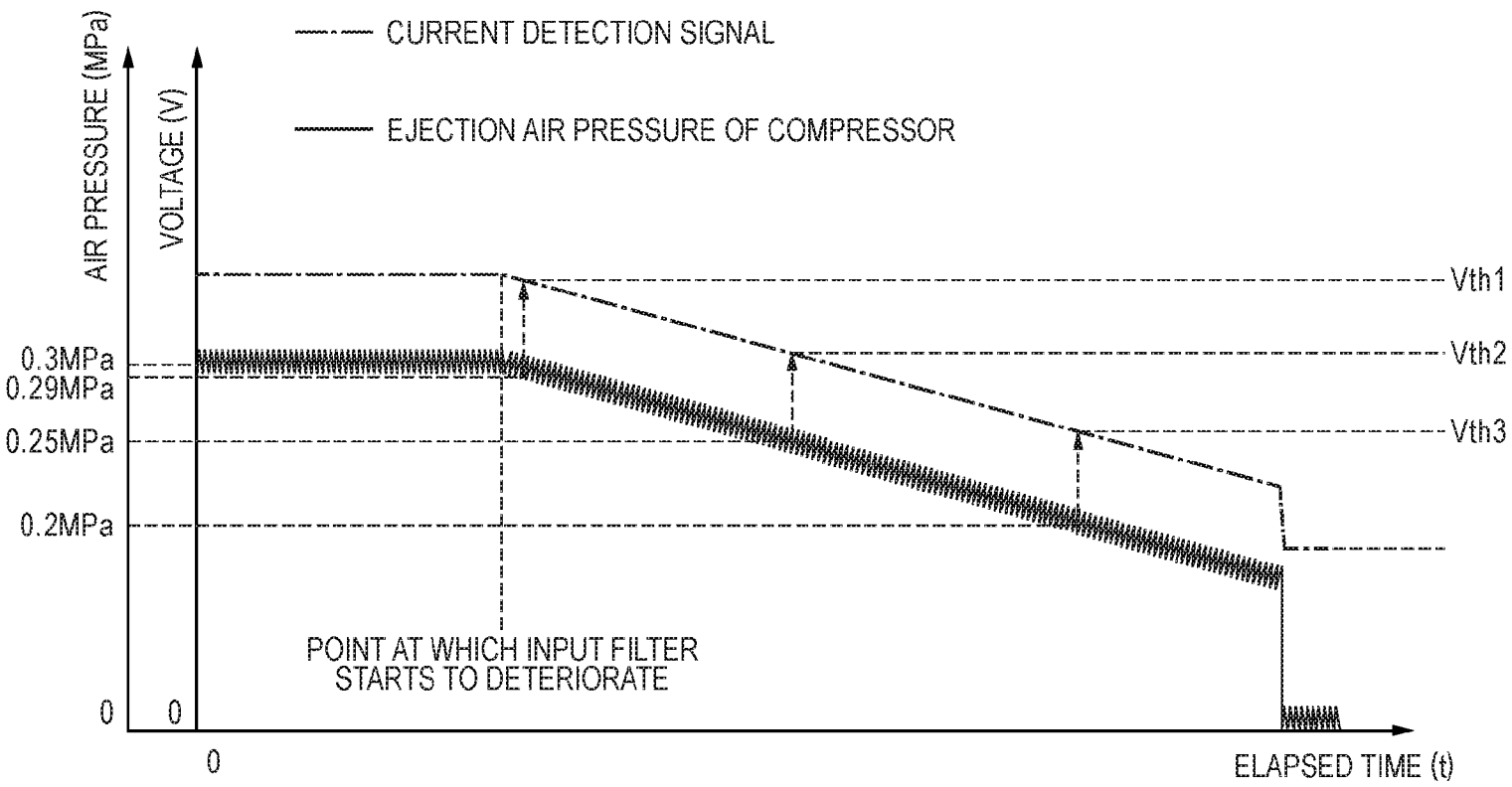
FIG. 9 is a graph for showing a threshold value for determining an ejection air pressure state of a compressor.

FIG. 9 is a graph for showing a relationship among the threshold values Vth1 to Vth3 used as parameters in the control flow illustrated in FIG. 7. The horizontal axis of FIG. 9 indicates an elapsed time t corresponding to an operation time of the image forming apparatus 300. The vertical axis of FIG. 9 indicates the ejection air pressure (MPa) of the compressor 371 and a detected voltage value (V) of the current detection signal. As to the plots within the graph, the ejection air pressure of the compressor 371 is plotted by the solid line. The current detection signal corresponding to the ejection air pressure is plotted by the one-dot chain line.

The threshold values Vth1 to Vth3 are threshold values set based on the characteristic expression stored in the memory 401 in Step S512 of FIG. 5, and are stored in the memory 401. The threshold values Vth1 to Vth3 are calculated when the characteristic expression is calculated in Step S511 of FIG. 5, and are stored in the memory 401 in Step S512.

The threshold value Vth1 (second reference value) is a value obtained by subtracting a voltage value corresponding to 0.01 MPa from the voltage Vt corresponding to the factory-adjusted ejection air pressure of 0.3 MPa of the compressor 371. That is, the threshold value Vth1 is a voltage value corresponding to the air pressure that has become a little lower than the factory-adjusted ejection air pressure. The threshold value Vth2 (first reference value) is a voltage value corresponding to 0.25 MPa, and is used to determine a timing to replace the input filter 372. The threshold value Vth3 (third reference value) is a voltage value corresponding to 0.2 MPa, and is used to determine a state of being unable to acquire a necessary ejection air pressure.

After the power of the image forming apparatus 300 is turned on, a job (print job) is input by the user. Then, the CPU 400 proceeds to the control flow of FIG. 7 (Step S701).

Subsequently, the CPU 400 determines which of "0" and "1" the value of a status flag (determination flag) CSTS of the compressor 371 is (Step S702). As the status flag CSTS, the value of 0 or 1 is set by the CPU 400 depending on a state of the compressor 371. A state with the status flag being 0 (normal) represents a state in which a normal ejection air pressure equivalent to an initial ejection air pressure is being output. Meanwhile, a state with the status flag being 1 (abnormal) represents a state in which the ejection air pressure becomes low so as not to perform the cleaning operation. The initial value of the status flag CSTS is factory-set to 0 (normal).

When determining that the status flag CSTS is 1, the CPU 400 proceeds to the flow of Step S732 and the subsequent steps to continuously execute the flow. Meanwhile, when determining that the status flag CSTS is 0, the CPU 400 activates the compressor 371 (Step S703). The CPU 400 activates the compressor 371 under the state in which the atmosphere release valve 302 is opened.

After activating the compressor 371, the CPU 400 causes all of the atmosphere release valve 302, the separation electromagnetic valve 394, the first cleaning electromagnetic valve 395, and the second cleaning electromagnetic valve 397 to stand by under the closed state. Under that state, the CPU 400 samples and measures (detects) the current value from the current detection signal corresponding to the drive current of the compressor 371. Then, the CPU 400 derives and determines the voltage value Vm corresponding to a drive current value Im being an average drive current obtained by averaging the plurality of sampling results (Step S704).

After that, the CPU 400 determines whether or not Vm≥Vth1 is established (Step S710). When determining that Vm≥Vth1 is established, the CPU 400 cancels inhibition of job reception for a medium that requires a separation operation of the compressor 371 (Step S707). Then, the CPU 400 cancels such notification to the UI screen as to replace the input filter 372 and to inhibit the job reception for the medium that requires the separation operation (Step S708). Then, the CPU 400 brings the flow to an end (Step S740), and proceeds to the image forming operation for the subsequent jobs.

When determining, in Step S710, that Vm≥Vth1 is not established, the CPU 400 further determines whether or not Vth2≤Vm<Vth1 is established (Step S711). In this case, when determining that Vth2≤Vm<Vth1 is not established, the CPU 400 proceeds to Step S721. The processing of Step S721 and the subsequent steps are described later. Meanwhile, when determining that Vth2≤Vm<Vth1 is established, the CPU 400 determines that the pressure on the ejection side necessary for the separation operation can be secured but the ejection air pressure becomes less than the factory-adjusted ejection air pressure of 0.3 MPa due to the deterioration of the input filter 372. In this case, the CPU 400 notifies to replace the input filter 372 via the UI screen, and prompts the user to carry out the replacement (Step S712). Then, the CPU 400 brings this flow to an end (Step S740), and proceeds to the image forming operation for the subsequent jobs.

When determining "No" in Step S711, the CPU 400 further determines whether or not Vth3≤Vm<Vth2 is established (Step S721). In this case, when determining that the condition is not established, the CPU 400 proceeds to Step S731. The processing of Step S731 and the subsequent steps are described later. Meanwhile, when determining in Step S721 that the condition is established, the CPU 400 inhibits the reception of the job using the medium type shown in FIG. 8 that requires the separation operation (Step S722). A condition that the compressor 371 needs to be driven is determined based on the basis weight of the medium type used for the job as shown in FIG. 8.

Specifically, the CPU 400 sets a medium degenerate operation state (state of inhibiting job reception) under which the user is not allowed to set the medium that requires the separation operation from an external host PC (not shown) or via the operation portion 4. Subsequently, the CPU 400 notifies the fact that medium setting has been inhibited to the user by displaying the fact on the UI screen. At this time, the notification to replace the input filter 372 is displayed together so that this notification is continuously given to the user (Step S723). Then, the CPU 400 brings this flow to an end (Step S740), and proceeds to the image forming operation for the subsequent job that can be received.

When determining in Step S721 that the condition is not established, the CPU 400 determines that Vm<Vth3 is established, sets 1 (abnormal) in the status flag CSTS, and stores the status flag CSTS in the memory 401 (Step S731). Then, the CPU 400 determines that an ejection pressure necessary not only for the separation operation but also for the cleaning operation cannot be obtained, and inhibits the reception of all the subsequent jobs (Step S732). In short, the image formation is inhibited. The CPU 400 displays an error indicating that the input filter 372 has deteriorated on the operation portion 4, notifies the user that the error is not to be canceled unless the input filter 372 is replaced (Step S733), and brings the flow to an end (Step S740). Until the user sets to cancel the error via the operation portion 4 after carrying out the filter replacement, even when the power of the image forming apparatus 300 is turned on from an off state, the value 1 of the status flag CSTS is held in the memory 401, and an error state is held.

According to the second embodiment, the pressure on the ejection side of the compressor 371 is adjusted so as to become predetermined pressures at two or more observation points in addition to the point in the no-load state point, and the drive current of the compressor 371 at each of those times is measured. The characteristic expression between the pressure on the ejection side of the compressor 371 and the drive current is calculated based on the measurement result. With this configuration, it is possible to estimate the air pressure on the ejection side with high accuracy based on a result of sampling and measuring the drive current by the CPU 400 and the characteristic expression.

The air pressure on the ejection side is monitored to determine whether or not the air pressure is equal to or smaller than a predetermined air pressure. This enables the detection of whether or not a stable air pressure is being output from the compressor 371 with an inexpensive and simple configuration. Therefore, it is possible to prevent the reduction in life of the fixing roller (e.g., the heating rollers 151, 161) due to the deterioration in separation performance and cleaning performance ascribable to the pressure abnormality accompanying the deterioration of the input filter 372.

Third Embodiment

In a hose or other such member configured to distribute the compressed air to each component, the compressed air may leak due to an assembly failure or deterioration with time. In this case, a jam ascribable to a separation failure may occur due to the insufficient separation performance of the sheet 10, or it may be difficult to maintain the surface roughness of the cleaning roller (e.g., the first refreshing roller 210 or the second refreshing roller 260) at a constant level. Therefore, there occurs an image failure ascribable to the fixing roller (e.g., the heating rollers 151, 161). In order to detect an abnormality in pressure or quantity of the compressed air ejected from the compressor 371, it is necessary to separately provide the sensor and the accompanying mechanism. This adversely increases the manufacturing cost or the size of the apparatus.

In order to solve the above-mentioned problem, an image forming apparatus 300 according to the third embodiment of the present invention is configured to determine a state of airtightness between the compressor 371 and the electromagnetic valve (e.g., one of the separation electromagnetic valve 394, the first cleaning electromagnetic valve 395, and the second cleaning electromagnetic valve 397) with high accuracy. Specifically, the image forming apparatus 300 according to the third embodiment monitors the drive current at the time of activation of the compressor 371, to thereby determine a state of the member configured to distribute the compressed air of the compressor 371. With this configuration, it is possible to determine the state of airtightness between the compressor 371 and the electromagnetic valve with an inexpensive and simple configuration. Therefore, it is possible to prevent the reduction in life of an image forming apparatus 300 (in particular, the fixing roller) due to the deterioration in separation performance or cleaning performance.

In the following description of the third embodiment, different points from those of the first embodiment are described, and descriptions of the components described in the first embodiment are omitted. Unless otherwise described, like components denoted by like reference symbols provide substantially the same operations and functions, and actions and effects thereof are also substantially the same.

Figure 10:
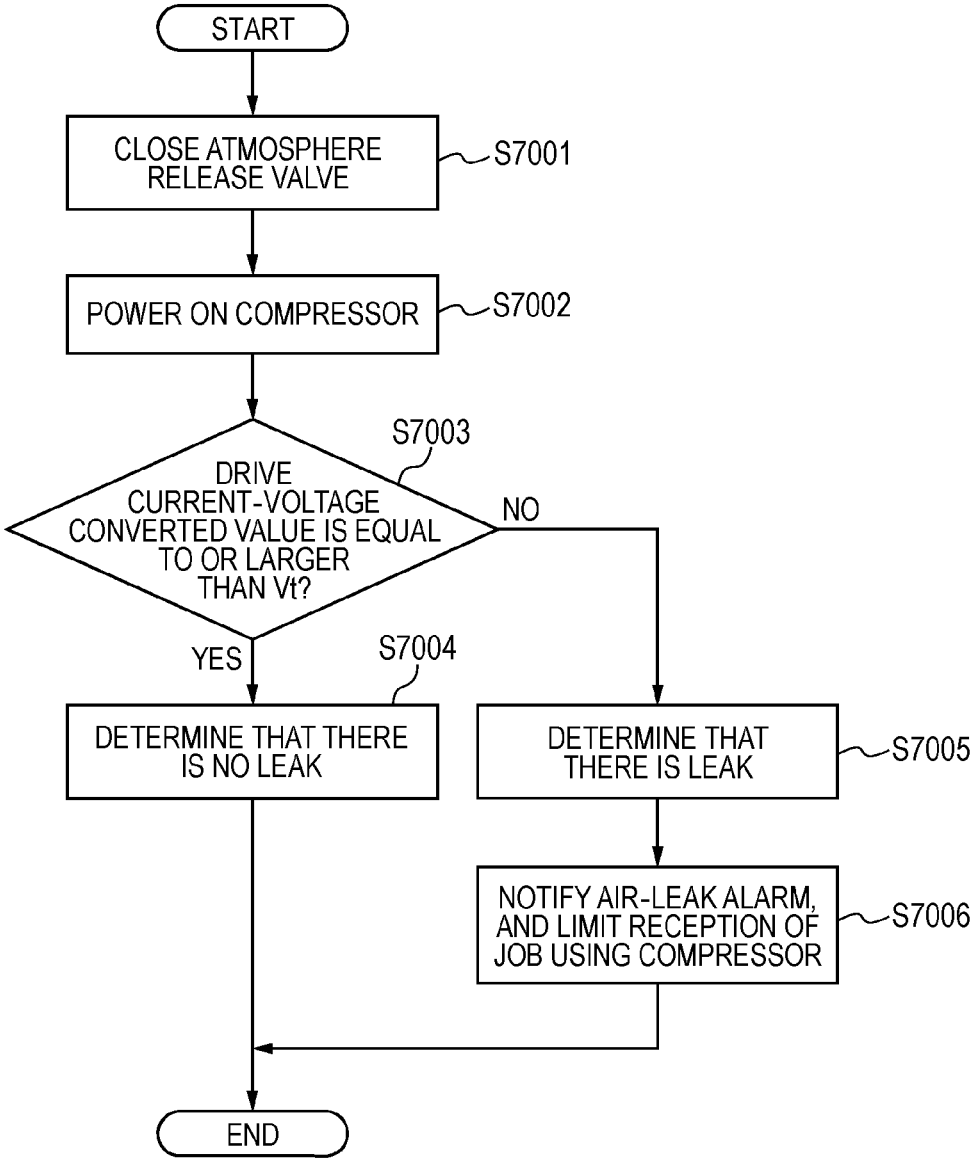
FIG. 10 is a flowchart for illustrating an example of a processing procedure for determining a state of airtightness between the compressor and an electromagnetic valve.

FIG. 10 is a flowchart for illustrating an example of a processing procedure for determining, by the image forming apparatus 300, the state of airtightness between the compressor 371 and the electromagnetic valve based on the characteristic expression derived in the processing illustrated in FIG. 5. Each step of the processing illustrated in FIG. 10 is performed mainly by the CPU 400. When the power of the image forming apparatus 300 is turned on, leakage detection, that is, the determination of the state of airtightness, is started. The compressor 371 needs to lower the load on the ejection side of the compressor 371 at the time of activation thereof. Therefore, the compressor 371 is normally activated by setting the state of the atmosphere release valve 302 to a valve-opened state.

The CPU 400 closes the atmosphere release valve 302 (Step S7001). The CPU 400 powers on (supplies an AC to) the compressor 371 under the valve-closed state for a short period of time, and measures the current value during that time period (Step S7002). When the state of the atmosphere release valve 302 is the valve-closed state, there is no way for air to escape on the ejection side. When the compressor 371 is driven under the valve-closed state, a load becomes heavier than in the case of the state in which the ejection pressure is 0.3 MPa at a time of a normal operation. Therefore, when there is no leak of the compressed air on the ejection side of the compressor 371, that is, under the state in which the airtightness is not lost, a current greater than the current It flows compared with the case of the state in which the ejection pressure is 0.3 MPa.

The CPU 400 determines whether or not a drive current-voltage converted value is equal to or greater than Vt (Step S7003). In this case, Vt represents a voltage value at the time of 0.3 MPa as shown in FIG. 6A. When the drive current-voltage converted value is equal to or greater than Vt (Yes in Step S7003), the CPU 400 determines that there is no leak of the compressed air, that is, the airtightness is not lost (Step S7004), and brings the determination processing to an end. When the compressor 371 is driven under the valve-closed state for a long time period, a load is imposed on the compressor 371. Thus, the processing is brought to an end after a short period of time, and the atmosphere release valve 302 is quickly opened.

When the drive current-voltage converted value is less than Vt (No in Step S7003), the CPU 400 determines that there is a leak of the compressed air, that is, the airtightness is lost (Step S7005). For example, when the airtightness between the compressor 371 and each electromagnetic valve is lost, the load is reduced even under the valve-closed state due to existence of a way for air to escape on the ejection side of the compressor 371.

The CPU 400 notifies (displays) that the airtightness between the compressor 371 and each electromagnetic valve is lost and a leak of the compressed air has occurred (for example, by alarm), or that parts replacement is necessary, via the operation portion 4. The CPU 400 limits the reception of the job using the compressor 371 (Step S7006). In this manner, it is possible to prevent the reduction in life of the image forming apparatus 300 (in particular, the fixing roller) due to the deterioration in separation performance or cleaning performance. While the compressor 371 is driven, the processing from Step S7003 to Step S7006 may be repeated.

Figure 11A:
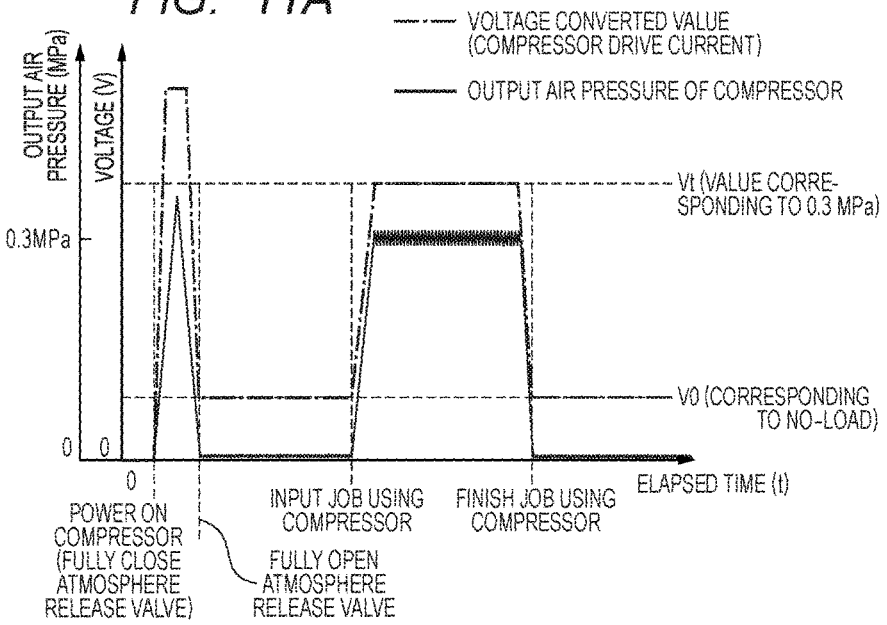
FIG. 11A is a graph for showing a relationship between a voltage conversion value of a current and an output air pressure that is exhibited when a leak has not occurred.
Figure 11B:
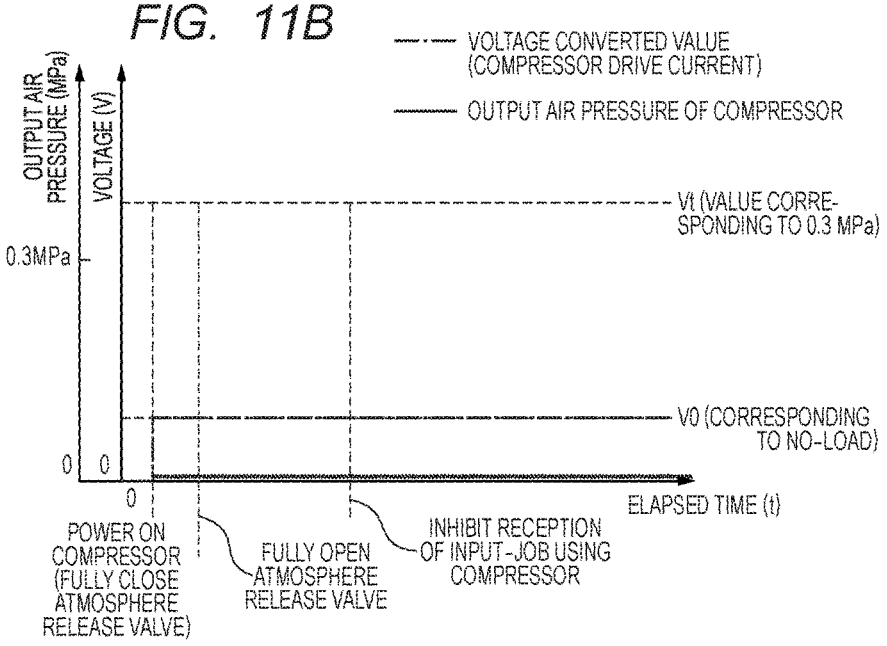
FIG. 11B is a graph for showing a relationship between the voltage conversion value of the current and the output air pressure that is exhibited when a leak has occurred.

FIG. 11A and FIG. 11B are each a graph for showing a relationship among the state of airtightness between the compressor 371 and the electromagnetic valve, a voltage conversion value of the current, and an output air pressure. In both FIG. 11A and FIG. 11B, the vertical axis indicates the output air pressure (ejection air pressure) (MPa) of the compressor 371 and the drive current-voltage converted value (voltage) (V) under the air pressure, and the horizontal axis indicates a time (t) that has elapsed since a main body of the image forming apparatus 300 is powered on. In FIG. 11A and FIG. 11B, the solid line indicates the ejection air pressure (output air pressure of the compressor 371), and the one-dot chain line indicates a change (voltage conversion value) of the voltage value with a lapse of time.

FIG. 11A is the graph for showing the relationship between the voltage conversion value of the current and the output air pressure that is exhibited when a "leak" of the compressed air has not occurred on the ejection side of the compressor 371. When the atmosphere release valve is closed to turn on the power of the compressor 371, a voltage higher than the voltage converted value Vt of the current at the time of 0.3 MPa is detected.

When the atmosphere release valve 302 is opened, a detected voltage becomes the voltage V0 in the no-load state due to the opening of the atmosphere release valve 302. After the atmosphere release valve 302 is brought into the valve-closed state again, when the compressor 371 is driven, the voltage at the time of 0.3 MPa that is set in a manufacturing process is detected.

FIG. 11B is the graph for showing the relationship between the voltage conversion value of the current and the output air pressure that is exhibited when a "leak" of the compressed air has occurred on the ejection side of the compressor 371. In the case in which a leak of the compressed air has occurred (that is, airtightness is lost), even when the atmosphere release valve 302 is in the valve-closed state, little load occurs in the same manner as in the case of the valve-opened state. Therefore, the detected voltage is extremely low.

The image forming system S (image forming apparatus 300) according to the third embodiment is configured to monitor the drive current of the AC motor at the time of the activation of the compressor 371. With this configuration, it is possible to determine the state of the member configured to distribute the compressed air of the compressor 371, that is, the state of airtightness between the compressor 371 and the electromagnetic valve. Therefore, it is possible to determine the state of airtightness between the compressor 371 and the electromagnetic valve with an inexpensive and simple configuration. In addition, it is possible to prevent the reduction in life of the image forming apparatus 300 (in particular, the fixing roller) accompanying the deterioration in separation performance or cleaning performance due to the abnormality in pressure of the compressed air.

The first embodiment, the second embodiment, and the third embodiment may be combined to be carried out.

The respective embodiments are described above in order to describe the present invention more specifically, and the scope of the present invention is not limited to those embodiments. The present invention can also be achieved by processing in which a program for implementing the function of at least one of the above-mentioned embodiments is supplied to a system or an apparatus through a network or a storage medium and is read and executed by at least one processor of a computer of the system or the apparatus. Further, the present invention can be achieved by a circuit (for example, an application-specific integrated circuit (ASIC)) for implementing at least one function.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

an image forming unit configured to form a toner image;

a transfer portion configured to transfer the toner image onto a sheet;

a fixing unit configured to fix the toner image to the sheet;

a compressor configured to output air based on a drive current supplied from a power source;

a detection portion configured to detect the drive current;

an ejection portion configured to eject the air output from the compressor;

a pipe configured to supply the air output from the compressor to the ejection portion; and a determination unit configured to determine a characteristic expression indicating a relationship between the drive current and an air pressure of the air based on a first detection result obtained by the detection portion when the air pressure is adjusted to a first predetermined value and a second detection result obtained by the detection portion when the air pressure is adjusted to a second predetermined value.

2. An image forming apparatus according to claim 1, wherein the ejection portion is configured to eject the air toward the fixing unit in order to peel off the sheet from the fixing unit.

3. An image forming apparatus according to claim 1, further comprising a refreshing roller configured to rub a surface of a heating roller of the fixing unit, wherein the ejection portion is configured to eject the air toward the refreshing roller.

4. An image forming apparatus according to claim 1, further comprising a release valve connected to the pipe, wherein the determination unit is configured to determine the characteristic expression based on the first detection result, the second detection result, and a third detection result obtained by the detection portion when the release valve is opened.

5. An image forming apparatus according to claim 1, wherein the determination unit is configured to determine a reference value from the characteristic expression, and the image forming apparatus further comprises a controller configured to notify a warning when a detection result obtained by the detection portion is less than the reference value.

6. An image forming apparatus according to claim 5, wherein the reference value comprises a voltage value corresponding to a predetermined air pressure, and the controller is configured to compare a voltage value corresponding to a current value derived from the characteristic expression based on the detection result with the voltage value corresponding to the predetermined air pressure.

7. An image forming apparatus according to claim 1, wherein the determination unit is configured to determine a first reference value and a second reference value greater than the first reference value from the characteristic expression, and the image forming apparatus further comprises a controller configured to notify a user to replace an input filter of the compressor when a detection result obtained by the detection portion is greater than the first reference value and less than the second reference value, and to inhibit image formation when the detection result obtained by the detection portion is less than the first reference value.

8. An image forming apparatus according to claim 7, wherein the determination unit is configured to determine a third reference value that is less than the first reference value from the characteristic expression, and the controller is configured to inhibit image formation using a predetermined sheet when the detection result obtained by the detection portion is less than the first reference value and equal to or greater than the third reference value.

9. An image forming apparatus according to claim 1, further comprising:

a first release valve connected to the pipe and configured to be opened so as to release the air output by the compressor to outside air;

a second release valve configured to be opened so as to supply the air output by the compressor to the ejection portion; and a controller configured to determine a state of airtightness between the compressor and the second release valve based on a current value obtained when the compressor is activated with the first release valve being closed, and (ii) the characteristic expression.

10. An image forming apparatus according to claim 9, wherein the controller is configured to perform one of notification of a warning and inhibition of image formation using a predetermined sheet when a voltage value corresponding to the current value obtained when the compressor is activated is less than a voltage value corresponding to a current value at a time of a normal operation that is derived from the characteristic expression.

* * * * *